US005800141A

United States Patent [19]

Ceylan et al.

[11] Patent Number: 5,800,141

[45] Date of Patent: Sep. 1, 1998

[54] SCROLL MACHINE WITH REVERSE ROTATION PROTECTION

[75] Inventors: Muzaffer Ceylan, Alsdorf, Germany; Jaroslav Blass, Plymouth, Minn.; Jean-Luc Caillat, Dayton, Ohio

[73] Assignee: Copeland Corporation, Sidney, Ohio

[21] Appl. No.: 754,821

[22] Filed: Nov. 21, 1996

[51] Int. Cl.[6] ..... F01C 1/04; F01C 19/08; F01C 21/16

[52] U.S. Cl. ..... 418/55.1; 418/55.4; 418/270

[58] Field of Search ..... 418/55.1, 55.4, 418/270

[56] References Cited

U.S. PATENT DOCUMENTS

| | | | |
|---|---|---|---|
| 4,545,747 | 10/1985 | Tamura et al. | 418/55.1 |
| 4,560,330 | 12/1985 | Murayama et al. | 418/55.1 |
| 4,696,627 | 9/1987 | Asano et al. | 418/15 |
| 4,840,545 | 6/1989 | Moilanen | 417/310 |
| 4,877,382 | 10/1989 | Caillat et al. | 418/57 |
| 5,074,760 | 12/1991 | Hirooka et al. | 417/310 |
| 5,090,880 | 2/1992 | Mashimo | 417/310 |
| 5,102,316 | 4/1992 | Caillat et al. | 418/55.5 |
| 5,103,652 | 4/1992 | Mizuno et al. | 418/97 |
| 5,141,420 | 8/1992 | Nambiar | 418/55.1 |
| 5,156,539 | 10/1992 | Anderson et al. | 418/55.4 |
| 5,186,616 | 2/1993 | Hirano | 418/55.5 |
| 5,224,848 | 7/1993 | Noburu et al. | 418/55.1 |
| 5,320,506 | 6/1994 | Fogt | 418/55.3 |

FOREIGN PATENT DOCUMENTS

| | | | |
|---|---|---|---|
| 58-172482 | 10/1983 | Japan | 418/55.1 |
| 59-23094 | 2/1984 | Japan | 418/55.1 |

*Primary Examiner*—John J. Vrablik

*Attorney, Agent, or Firm*—Harness, Dickey & Pierce, P.L.C.

[57] ABSTRACT

A scroll compressor includes a discharge valve assembly for blocking compressed refrigerant flow from the discharge chamber through the scroll members. This blocking of flow results in the elimination of reverse rotation at shut down. The discharge valve assembly includes a leakage path which allows a limited amount of refrigerant flow past the discharge valve to eliminate the forming of a vacuum during powered reverse rotation. In one embodiment, a valve located in the leakage path provides a time delay to optimize the performance of the discharge valve assembly.

16 Claims, 3 Drawing Sheets

SCROLL MACHINE WITH REVERSE ROTATION PROTECTION

FIELD OF THE INVENTION

The present invention relates generally to scroll machines. More particularly, the present invention relates to a device for the reduction or elimination of reverse rotation problems in scroll machines such as those used as compressors to compress refrigerant in refrigerating, air-conditioning and heat pump systems, as well as compressors used in air compressing systems.

BACKGROUND AND SUMMARY OF THE INVENTION

Scroll machines are becoming more and more popular for use as compressors in both refrigeration as well as air conditioning and heat pump applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port towards a center discharge port. An electric motor is normally provided which operates to drive the orbiting scroll member via a suitable drive shaft.

Because scroll compressors depend upon successive chambers for compression, suction and discharge processes, suction and discharge valves in general are not required. However, when such compressors are shut down, either intentionally as a result of the demand being satisfied, or unintentionally as a result of a power interruption, there is a strong tendency for the backflow of compressed gas from the discharge chamber and to a lesser degree for the gas in the pressurized chambers to effect a reverse orbital movement of the orbiting scroll member and its associated drive shaft. This reverse movement often generates noise or rumble which may be considered objectionable and undesirable. Further, in machines employing a single phase drive motor, it is possible for the compressor to begin running in the reverse direction should a momentary power interruption be experienced. This reverse operation may result in overheating of the compressor and/or other inconveniences to the utilization of the system. Additionally, in some situations, such as a blocked condenser fan, it is possible for the discharge pressure to increase sufficiently to stall the drive motor and effect a reverse rotation thereof. As the orbiting scroll orbits in the reverse direction, the discharge pressure will decrease to a point where the motor again is able to overcome this pressure head and orbit the scroll member in the forward direction. However, the discharge pressure will again increase to a point where the drive motor is stalled and the cycle is repeated. Such cycling is undesirable in that it is self-perpetuating.

A primary object of the present invention resides in the provision of a very simple and unique valve which is associated with the floating seal and can be easily assembled into a conventional gas compressor of the scroll type without significant modification of the overall compressor design, and which functions at compressor shut down to increase the effectiveness of the floating seal which upon shut down of the compressor will move to allow gas flow from the discharge pressure zone to the suction pressure zone. This flow will balance the discharge gas with the suction gas thereby preventing discharge gas from driving the compressor in the reverse direction which in turn eliminates the normal shut down noise associated with such reverse rotation.

These and other features of the present invention will become apparent from the following description and the appended claims, taken in conjunction with the accompanying drawings.

BRIEF DESCRIPTION OF THE DRAWINGS

In the drawings which illustrate the best mode presently contemplated for carrying out the present invention.

DESCRIPTION OF THE PREFERRED EMBODIMENTS

Figure 1:
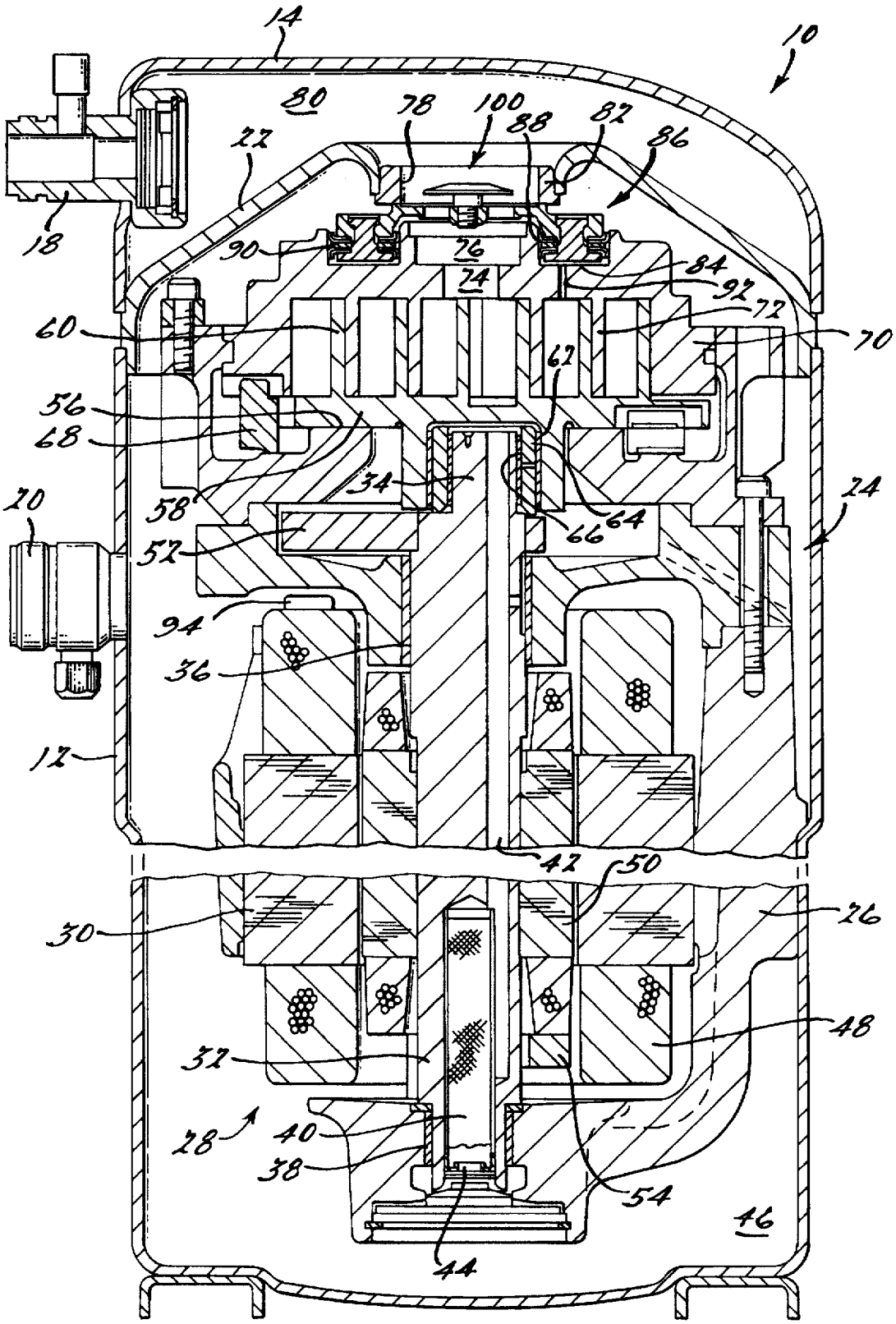
FIG. 1 is a vertical sectional view through the center of a scroll compressor which incorporates a valve assembly in accordance with the present invention.

While the present invention is suitable for incorporation in many different types of scroll machines, for exemplary purposes it will be described herein incorporated in a scroll refrigerant compressor of the general structure illustrated in FIG. 1. Referring now the drawings and in particular to FIG. 1, a compressor 10 is shown which comprises a generally cylindrical hermetic shell 12 having welded at the upper end thereof a cap 14. Cap 14 is provided with a refrigerant discharge fitting 18 which may have the usual discharge valve therein (not shown). Other major elements affixed to the shell include an inlet fitting 20, a transversely extending partition 22 which is welded about its periphery at the same point that cap 14 is welded to shell 12, a two piece main bearing housing 24 and a lower bearing housing 26 having a plurality of radially outwardly extending legs each of which is suitably secured to shell 12. Lower bearing housing 26 locates and supports within shell 12 two piece main bearing housing 24 and a motor 28 which includes a motor stator 30.

A drive shaft or crankshaft 32 having an eccentric crank pin 34 at the upper end thereof is rotatably journaled in a bearing 36 in main bearing housing 24 and a second bearing 38 in lower bearing housing 26. Crankshaft 32 has at the lower end a relatively large diameter concentric bore 40 which communicates with a radially outwardly located smaller diameter bore 42 extending upwardly therefrom to the top of crankshaft 32. Disposed within bore 40 is a stirrer 44. The lower portion of the interior shell 12 defines an oil sump 46 which is filled with lubricating oil. Bore 40 acts as a pump to pump lubricating fluid up the crankshaft 32 and into bore 42 and ultimately to all of the various portions of the compressor which require lubrication.

Crankshaft 32 is rotatively driven by electric motor 28 including motor stator 30, windings 48 passing therethrough and a motor rotor 50 press fitted on crankshaft 32 and having upper and lower counterweights 52 and 54, respectively.

The upper surface of two piece main bearing housing 24 is provided with a flat thrust bearing surface 56 on which is disposed an orbiting scroll member 58 having the usual spiral vane or wrap 60 on the upper surface thereof. Projecting downwardly from the lower surface of orbiting scroll member 58 is a cylindrical hub having a journal bearing 62 therein and in which is rotatively disposed a drive bushing 64 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Letters Pat. No. 4,877,382, the disclosure of which is hereby incorporated herein by reference. An Oldham coupling 68 is also provided positioned between orbiting scroll member 58 and bearing housing 24. Oldham coupling 68 is keyed to orbiting scroll member 58 and a non-orbiting scroll member 70 to prevent rotational movement of orbiting scroll member 58. Oldham coupling 68 is preferably of the type disclosed in assignee's U.S. Letters Pat. No. 5,320,506, the disclosure of which is hereby incorporated herein by reference.

Non-orbiting scroll member 70 is also provided having a wrap 72 positioned in meshing engagement with wrap 60 of orbiting scroll member 58. Non-orbiting scroll member 70 has a centrally disposed discharge passage 74 which communicates with an upwardly open recess 76 which in turn is in fluid communication via an opening 78 in partition 22 with a discharge muffler chamber 80 defined by cap 14 and partition 22. The entrance to opening 78 has an annular seat portion 82 therearound. Non-orbiting scroll member 70 has in the upper surface thereof an annular recess 84 having parallel coaxial sidewalls in which is sealingly disposed for relative axial movement an annular floating seal assembly 86 which serves to isolate the bottom of recess 84 from the presence of gas under discharge pressure at 88 and suction pressure at 90 so that it can be placed in fluid communication with a source of intermediate fluid pressure by means of a passageway 92. Non-orbiting scroll member 70 is thus axially biased against orbiting scroll member 58 to enhance wrap tip sealing by the forces created by discharge pressure acting on the central portion of scroll member 70 and those created by intermediate fluid pressure acting on the bottom of recess 84. Discharge gas in recess 76 and opening 78 is also sealed from gas at suction pressure in the shell by means of seal assembly 86 acting against seat portion 82. This axial pressure biasing and the functioning of floating seal assembly 86 are disclosed in greater detail in applicant's assignee's U.S. Letters Pat. No. 5,156,539, the disclosure of which is hereby incorporated herein by reference. Non-orbiting scroll member 70 is designed to be mounted to bearing housing 24 in a suitable manner which will provide limited axial (and no rotational) movement of non-orbiting scroll member 70. Non-orbiting scroll member 70 may be mounted in the manner disclosed in the aforementioned U.S. Pat. No. 4,877,382 or U.S. Pat. No. 5,102,316, the disclosure of which is hereby incorporated herein by reference.

The compressor is preferably of the "low side" type in which suction gas entering via fitting 20 is allowed, in part, to flow into the shell and assist in cooling the motor. So long as there is an adequate flow of returning suction gas the motor will remain within desired temperature limits. When this flow decreases significantly or ceases, however, the loss of cooling will cause a motor protector 94 to trip and shut the machine down.

The scroll compressor as thus far broadly described is either now known in the art or is the subject of other pending applications for patent or patents of applicant's assignee.

The present invention is directed towards a mechanical valve assembly 100 which is integrated into floating seal assembly 86. Valve assembly 100 remains fully open during steady state operation of compressor 10 and will close only during the shut down of compressor 10. Once valve assembly 100 is fully closed, floating seal assembly 86 will be pushed down because of the pressure differential and allow gas to flow from the discharge side to the suction side of compressor 10.

Figure 2:
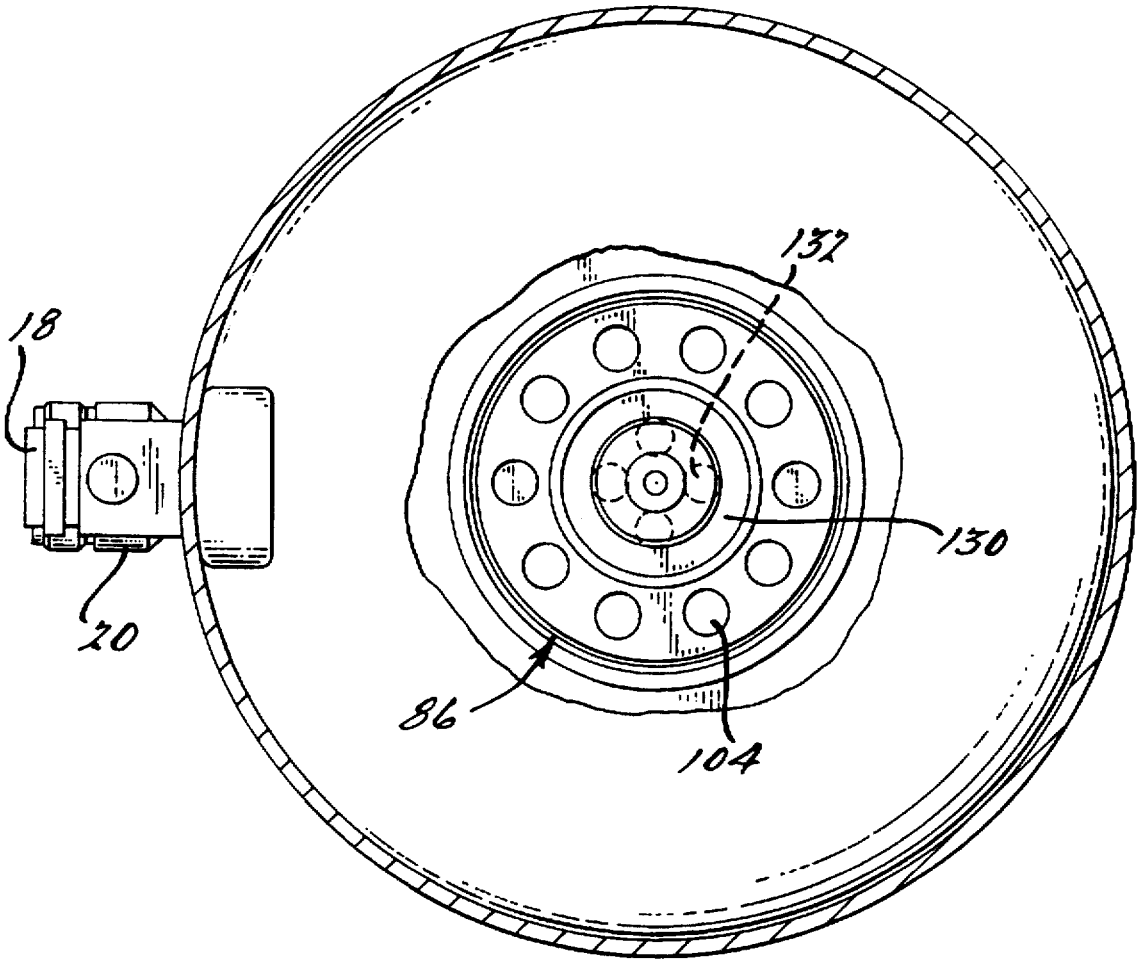
FIG. 2 is a top elevational view of the compressor shown in FIG. 1 with the cap and a portion of the partition removed.
Figure 3:
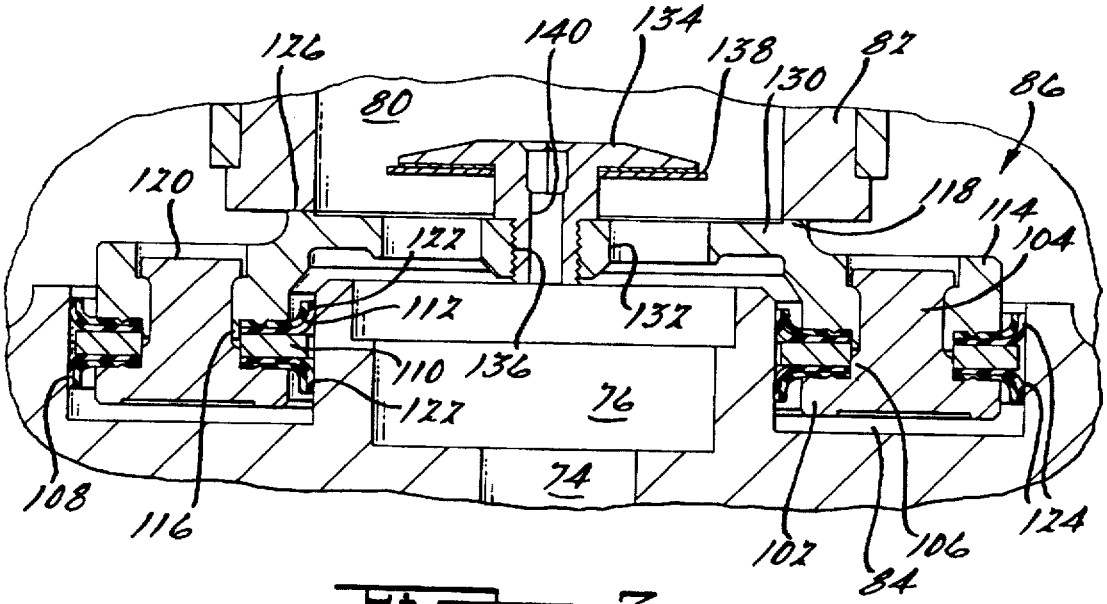
FIG. 3 is an enlarged view of the floating seal assembly illustrated in FIG. 1.

Referring now to FIGS. 2 and 3, floating seal assembly 86 is of a coaxial sandwiched construction and comprises an annular base plate 102 having a plurality of equally spaced upstanding integral projections 104 each having an enlarged base portion 106. Disposed on plate 102 is an annular gasket assembly 108 having a plurality of equally spaced holes which mate with and receive base portions 106. On top of gasket assembly 108 is disposed an annular spacer plate 110 having a plurality of equally spaces holes which also mate with and receive base portions 106. On top of plate 110 is an annular gasket assembly 112 having a plurality of equally spaced holes which mate with and receive projections 104. The assembly of seal assembly 86 is maintained by an annular upper seal plate 114 which has a plurality of equally spaced holes mating with and receiving projections 104. Seal plate 114 includes a plurality of annular projections 116 which mate with and extend into the plurality of holes in spacer plate 110 to provide stability to seal assembly 86. Seal plate 114 also includes an annular upwardly projecting planar sealing lip 118. Seal assembly 86 is secured together by swaging the ends of projections 104 as indicated at 120.

Referring now to FIG. 3, seal assembly 86 therefore provides three distinct seals. First, an inside diameter seal at two interfaces 122, second an outside diameter seal at two interfaces 124 and a top seal at 126. Seals 122 isolate fluid under intermediate pressure in the bottom of recess 84 from fluid in recess 76. Seals 124 isolate fluid under intermediate pressure in the bottom of recess 84 from fluid within shell 12. Seal 126 is between sealing lip 118 and annular seat portion 82. Seal 126 isolates fluid at suction pressure from fluid at discharge pressure across the top of seal assembly 86.

The diameter of seal 126 is chosen so that there is a positive sealing force on seal assembly 86 under normal operating conditions of compressor 10, i.e., at normal pressure differentials. Therefore, when undesirable pressure conditions are encountered, seal assembly 86 will be forced downward, thereby permitting fluid flow from the discharge pressure zone of compressor 10 to the suction pressure zone of compressor 10. If this flow is great enough, the resultant loss of flow of motor-cooling suction gas (aggravated by the excessive temperature of the leaking discharge gas) will cause motor protector 94 to trip thereby de-energizing motor 28. The width of seal 126 is chosen so that the unit pressure between sealing lip 118 and seat portion 82 is greater than normally encountered discharge pressure, thus ensuring consistent sealing.

Disposed within the inner periphery of sealing lip 118 is a discharge valve base 130. Discharge valve base 130 includes a plurality of apertures 132 which permit the flow of compressed gas from recess 76 into muffler chamber 80. A mushroom shaped valve retainer 134 is secured to a central aperture 136 disposed within valve base 130 by a threaded connection or any other manner known in the art. Disposed between valve base 130 and valve retainer 134 is an annular valve disc 138. The diameter of valve disc 138 is large enough to cover the plurality of apertures 132 when valve disc 138 is seated onto valve base 130 as shown in phantom in FIG. 3. The diameter of the upper portion of retainer 134 which is in contact with valve disc 138 is chosen to be less than and in a desirable proportion to the diameter of valve disc 138 to control the forces acting on the valve during the operation and shut down of compressor 10. The diameter of the upper portion of retainer 134 is chosen to be between 50% and 100% of the diameter of valve disc 138. In the preferred embodiment the diameter of the upper portion of retainer 134 is chosen to be approximately 95% of the diameter of valve disc 138. During operation of compressor 10, it is undesirable for valve disc 138 to become dynamic under the flow pulsations that occur during extreme conditions of operation such as at high pressure ratio. The proper contact area between valve disc 138 and valve retainer 134 and a phenomenon know as "stiction" will prevent valve disc 138 from becoming dynamic. Stiction is a temporary time dependent adhesion of valve disc 138 to valve retainer 134 caused by surface tension of lubricating oil being disposed between them.

Valve retainer 134 is provided with a central through aperture 140 which is sized to allow a proper amount of discharge gas to pass through valve retainer 134 when valve disc 138 closes apertures 132. This flow of gas through valve retainer 134 limits the amount of vacuum which can be created during powered reverse rotation of compressor 10. This powered reverse rotation can occur due to a three phase miswiring condition or it can occur due to various situations such as a blocked condenser fan where the discharge pressure builds up to a point of stalling drive motor 28. If aperture 140 is chosen too small of a diameter, excess vacuum will be created during reverse operation. If aperture 140 is chose to large, reverse rotation of compressor 10 at shut down will not be adequately prevented.

During normal operation of compressor 10, valve disc 138 is maintained in an open position, as shown in FIG. 3, and pressurized refrigerant flows from discharge passage 74, into open recess 76, through the plurality of apertures 132 and into discharge muffler chamber 80. When compressor 10 is shut down either intentionally as a result of the demand being satisfied or unintentionally as a result of a power interruption, there is a strong tendency for the backflow of compressed refrigerant from discharge muffler chamber 80 and to a lesser degree for the gas in the pressurized chambers defined by scroll wraps 60 and 72 to effect a reverse orbital movement of orbiting scroll member 58. Valve disc 138 is initially held in its open position due to stiction as described above. When compressor 10 is shut down, the forces due to the initial reverse flow of compressed refrigerant and, in this particular design to a lesser extent, those due to the force of gravity will eventually overcome the temporary time dependent "stiction" adhesion and valve disc 138 will drop onto valve base 130 and close the plurality of apertures 132 and stop the flow of compressed refrigerant out of discharge muffler chamber 80 except for the amount allowed to flow through aperture 140. The limited flow through aperture 140 is not sufficient to prevent floating seal assembly 86 from dropping thus enabling the breaking of seal 126 and allowing refrigerant at discharge pressure to flow to the suction pressure area of compressor 10 to equalize the two pressures and stop reverse rotation of orbiting scroll member 58.

Thus, floating seal assembly 86 which includes valve base 130, valve retainer 134 and valve disc 138 limits the amount of pressurized refrigerant that is allowed to backflow through compressor 10 after shut down. This limiting of refrigerant backflow has the ability to control the shut down noise without having an adverse impact on the performance of compressor 10. The control of shut down noise is thus accomplished in a simple and low cost manner.

During powered reversals aperture 140 allows sufficient refrigerant backflow to limit any vacuum from being created and thus provides sufficient volume of refrigerant to protect scroll members 58 and 70 until motor protector 94 trips and stops compressor 10.

Figure 4:
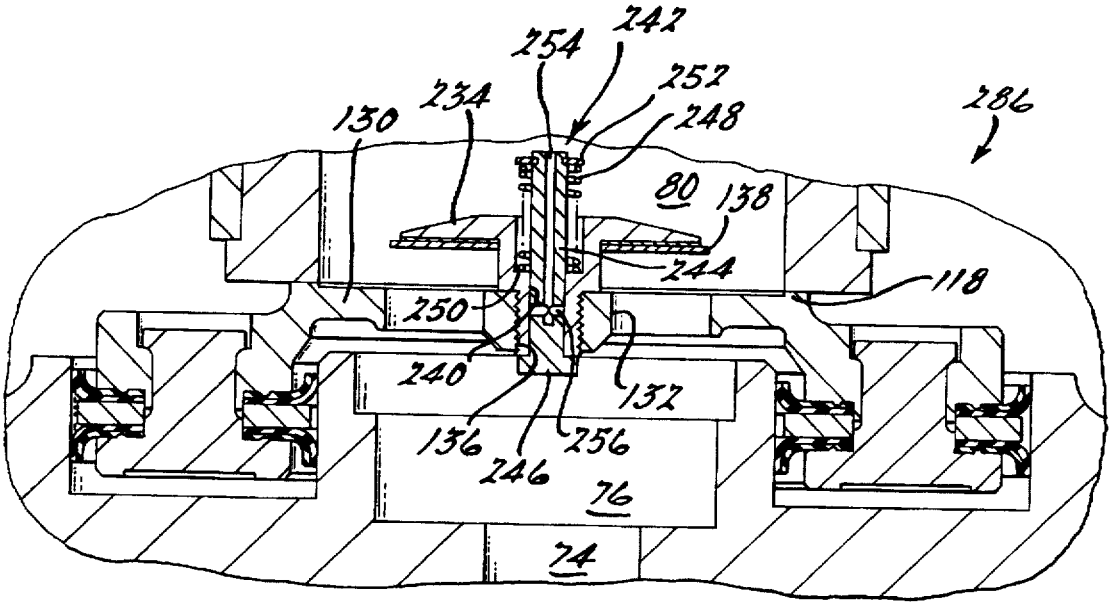
FIG. 4 is a view similar to FIG. 3 but showing another embodiment in accordance with the present invention.

FIG. 4 illustrates a floating seal assembly 286 in accordance with another embodiment of the present invention. Reverse rotation elimination and powered reverse rotation protection have mutually exclusive requirements. Reverse rotation elimination requires that valve disc 138 close apertures 132 as fast as possible in that as little pressurized gas as possible be supplied to scroll members 58 and 70 for expansion thereby eliminating the driving force for the reverse rotation. Powered reverse rotation protection requires that gas from discharge muffler chamber 80 be allowed to flow in the reverse direction through scroll members 58 and 70 so that a vacuum within the compression chambers formed by scroll wraps 60 and 72 is limited. The limitation of the vacuum will help prevent frictional damage between scroll members 58 and 70.

The embodiment described above in FIGS. 1 through 3, is a functional compromise between eliminating reverse rotation and providing protection during powered reverse rotation. The diameter of aperture 140 is chosen to allow a proper amount of gas to bypass valve disc 138 during powered reversals but limits the amount of flow to significantly reduce the amount of reverse rotation of the scrolls during shut down. Floating seal assembly 286 reconciles these opposing requirements by providing a time delay feature for the backflow of refrigerant during a powered reverse rotation. The equalizing of pressure between the discharge pressure zone and the suction zone occurs in a relatively short time period. By delaying the backflow of refrigerant which bypasses valve disc 138 for a time period essentially equal to this pressure equalization time, both the reverse rotation elimination and the powered reverse rotation protection can be achieved.

Floating seal assembly 286 includes discharge valve base 130 within the inner periphery of sealing lip 118. Discharge valve base 130 includes the plurality of apertures 132 which permit the flow of compressed gas from recess 76 into muffler chamber 80. A mushroom shaped valve retainer 234 is secured to central aperture 136 disposed within valve base 130 by a threaded connection or any other manner known in the art. Disposed between valve retainer 234 and valve base 130 is annular valve disc 138. The diameter of valve disc 138 is large enough to cover the plurality of apertures 132 when valve disc 138 is seated onto valve base 130 as shown in phantom in FIG. 4. The diameter of the upper portion of valve retainer 234 which is in contact with valve disc 138 is chosen to be less than and in a desirable proportion to the diameter of valve disc 138 to control the forces acting on the valve during the operation and shut down of compressor 10. The diameter of the upper portion of retainer 234 is chosen to be between 50% and 100% of the diameter of valve disc 138. In the preferred embodiment the diameter of the upper portion of retainer 234 is chosen to be approximately 95% of the diameter of valve disc 138. Valve retainer 234 is provided with a central through aperture 240 within which is slidingly disposed a valve stem 242. Valve stem 242 includes a shaft 244 and a valve head 246. The sliding friction between shaft 244 and aperture 240 provides a damping effect to the movement of valve stem 242. A spring 248 is disposed between a shoulder 250 formed by through aperture 240 and a retainer 252 extending through the end of shaft 244. Spring 248 biases valve stem 242 such that valve head 246 is biased against the end of valve retainer 234. Valve stem 242 defines an axially extending bore 254 which mates with a diametrically extending bore 256. Bore 256 opens into the lower portion of aperture 240.

During normal operation of compressor 10, valve disc 138 is maintained in an open position as shown in FIG. 4, and pressurized refrigerant flows from discharge passage 74 into open recess 76 through the plurality of apertures 132 and into discharge muffler chamber 80. Spring 248 biases valve head 246 against the end of valve retainer 234 to close apertures 240, 254 and 256. When compressor 10 is shut down either intentionally as a result of the demand being satisfied or unintentionally as a result of a power interruption, there is a strong tendency for the backflow of compressed refrigerant from discharge muffler chamber 80 and to a lesser extent for the gas in the pressurized chambers defined by scroll wraps 60 and 72 to effect a reverse orbital movement of orbiting scroll member 58. The initial reverse flow of compressed refrigerant will cause valve disc 138 to drop onto valve base 130 and close the plurality of apertures 132. The closing of the plurality of apertures 132 in combination with valve head 246 closing apertures 240, 254 and 256 due to the biasing of spring 248 stops the entire flow of compressed refrigerant out of discharge muffler chamber 80 into scroll members 58 and 70 thus eliminating reverse rotation of scroll member 58. This stopping of refrigerant flow causes floating seal assembly 286 to drop enabling the breaking of seal 126 and allowing refrigerant at discharge pressure to flow to the suction pressure area of compressor 10. This flow equalizes the pressure and prevents reverse rotation of scroll member 58. The pressure equalization occurs in approximately 0.2 seconds which is quicker than the time necessary for valve head 246 to unseat from valve retainer 234 due to the damping effect of the friction between shaft 244 and aperture 240, the inertia of the system and the biasing of spring 248 which provides the desired time delay.

Thus, floating seal assembly 286 which includes valve base 130, valve retainer 234, valve disc 138 and valve stem 242 blocks the flow of pressurized fluid that is allowed to flow through compressor 10 after shut down for a period of time sufficient for pressure equalization to occur. This blocking of refrigerant backflow controls the shut down noise without having an adverse impact on the performance of compressor 10. The control of shut down noise is thus accomplished in simple and low cost manner.

During powered reversals which may occur after a momentary power failure in a single phase motor, valve disc 138 and valve head 246 will block the initial backflow of refrigerant. This blocking of refrigerant flow will cause a partial vacuum which will quickly unseat valve head 246 from valve retainer 234 allowing refrigerant flow through bores 254 and 256 to limit the vacuum which is being created. The limiting of the vacuum provides sufficient flow of refrigerant to protect scroll members 58 and 70 until motor protector 94 trips and stops compressor 10. The momentary delay in refrigerant backflow caused by spring 248 holding valve head 246 in contact with valve retainer 234, the damping due to friction between shaft 244 and aperture 240 and the inertia of the valve system is inconsequential to the powered reverse rotation protection while being a distinct advantage for the reverse rotation elimination. This powered reverse rotation protection can occur due to a miswiring condition or it can occur due to various situations such as blocked condenser fan where the discharge pressure builds up to a point of stalling drive motor 28.

While the above detailed description describes the preferred embodiments of the present invention, it should be understood that the present invention is susceptible to modification, variation and alteration without deviating from the scope and fair meaning of the subjoined claims.

What is claimed is:

1. A scroll machine comprising:

a shell defining a discharge chamber;

a first scroll member disposed in said shell, said first scroll member having a first spiral wrap projecting outwardly from an end plate;

a second scroll member disposed in said shell, said second scroll member having a second spiral wrap projecting outwardly from an end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone, said discharge pressure zone being in fluid communication with said discharge chamber;

a discharge valve disposed between said discharge pressure zone and said discharge chamber, said discharge valve movable between an open position where fluid flow between said discharge pressure zone and said discharge chamber is permitted and a closed position where fluid flow between said discharge chamber and said discharge pressure zone is prohibited;

a flow path disposed between said discharge chamber and said discharge pressure zone, said flow path being open when said discharge valve is in said closed position; and a control valve disposed within said flow path, said control valve being movable between an open position where fluid flow through said flow path is permitted and a closed position where fluid flow through said flow path is prohibited.

2. The scroll machine according to claim 1 wherein, said scroll machine includes a first component and a second component defining a leakage path disposed between said discharge pressure zone and said suction pressure zone, said leakage path being closed due to the influence of a pressurized fluid urging said first component towards said second component.

3. The scroll machine according to claim 1 wherein, said control valve is biased into said closed position.

4. The scroll machine according to claim 1 wherein, said discharge valve comprises:

a valve base;

a valve retainer secured to said valve base; and a valve disc disposed between said valve base and said valve retainer.

5. The scroll machine according to claim 4 wherein, said flow path extends through said valve retainer.

6. The scroll machine according to claim 4 wherein, said valve disc is an annular shaped disc having an outside diameter and said valve retainer includes an annular contact area which mates with said valve disc, said annular contact area having an outside diameter equal to 50–100% of the outside diameter of said valve disc.

7. The scroll machine according to claim 6 wherein, said outside diameter of said annular contact area is 95% of the outside diameter of said valve disc.

8. A scroll machine comprising:

a shell defining a discharge chamber;

a first scroll member disposed in said shell, said first scroll member having a first spiral wrap projecting outwardly from an end plate;

a second scroll member disposed in said shell, said second scroll member having a second spiral wrap projecting outwardly from an end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone, said discharge pressure zone being in fluid communication with said discharge chamber;

a discharge valve assembly disposed between said discharge pressure zone and said discharge chamber, said discharge valve assembly permitting fluid flow from said discharge pressure zone to said discharge chamber when in an open condition and restricting flow from said discharge chamber to said discharge pressure zone when in a closed position, said discharge valve assembly defining an aperture extending between said discharge pressure zone and said discharge chamber for providing a limited flow of fluid between said discharge chamber and said discharge pressure zone when said valve assembly is in said closed position; and a control valve disposed within said aperture, said control valve being movable between an open position where fluid flow through said aperture is permitted and a closed position where fluid flow through said aperture is prohibited.

9. The scroll machine according to claim 8 wherein, said scroll machine includes a first component and a second component defining a leakage path disposed between said discharge pressure zone and said suction pressure zone, said leakage path being closed due to the influence of a pressurized fluid urging said first component towards said second component.

10. The scroll machine according to claim 8 wherein, said control valve is biased into said closed position.

11. The scroll machine according to claim 8 wherein, said discharge valve assembly comprises:

a valve base;

a valve retainer secured to said valve base; and a valve disc disposed between said valve base and said valve retainer.

12. The scroll machine according to claim 11 wherein, said aperture through said valve retainer.

13. The scroll machine according to claim 8 wherein, said valve disc is an annular shaped disc having an outside diameter and said valve retainer includes an annular contact area which mates with said valve disc, said annular contact area having an outside diameter equal to 50–100% of the outside diameter of said valve disc.

14. The scroll machine according to claim 13 wherein, said outside diameter of said annular contact area is 95% of the outside diameter of said valve disc.

15. A scroll machine comprising:

a shell defining a discharge chamber;

a first scroll member disposed in said shell, said first scroll member having a first spiral wrap projecting outwardly from an end plate;

a second scroll member disposed in said shell, said second scroll member having a second spiral wrap projecting outwardly from an end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone, said discharge pressure zone being in fluid communication with said discharge chamber;

a leakage path disposed between said discharge pressure zone and said suction pressure zone;

a floating seal disposed within one of said scroll members, said floating seal closing said leakage path due to the influence of a pressurized fluid;

a discharge valve disposed on said floating seal between said discharge pressure zone and said discharge chamber, said discharge valve movable between an open position where fluid flow between said discharge pressure zone and said discharge chamber is permitted and a closed position where fluid flow between said discharge chamber and said discharge pressure zone is prohibited;

a flow path disposed between said discharge chamber and said discharge pressure zone, said flow path being open when said discharge valve is in said closed position; and a control valve disposed within said flow path, said control valve being movable between an open position where fluid flow through said flow path is permitted and a closed position where fluid flow through said flow path is prohibited.

16. The scroll machine according to claim 15 wherein, said control valve is biased into said closed position.

* * * * *

UNITED STATES PATENT AND TRADEMARK OFFICE

CERTIFICATE OF CORRECTION

PATENT NO. : 5,800,141

DATED : September 1, 1998

INVENTOR(S) : Muzaffer Ceylan et al

It is certified that error appears in the above-identified patent and that said Letters Patent is hereby corrected as shown below:

Column 2, line 27, after "now" insert -- to --.

Column 3, line 38, "applicant's" should be -- applicants' --.

Column 3, line 58, "applicant's" should be -- applicants' --.

Column 4, line 9, "spaces" should be -- spaced --.

Column 5, line 23, "chose to" should be -- chosen too --.

Column 8, line 16, before "fluid" insert -- said --.

Column 8, line 17, "flow" should be -- communication --.

Column 8, line 19, "fluid flow" should be -- said fluid communication --.

Column 9, line 7, "fluid flow" should be -- said fluid communication --.

UNITED STATES PATENT AND TRADEMARK OFFICE

CERTIFICATE OF CORRECTION

PATENT NO. : 5,800,141
DATED : September 1, 1998
INVENTOR(S) : Muzaffer Ceylan et al

It is certified that error appears in the above-identified patent and that said Letters Patent is hereby corrected as shown below:

Column 9, line 9, "flow" should be -- said fluid communication --.

Column 9, line 38, after "aperture" insert -- extends --.

Column 10, line 28, "fluid flow" should be -- said fluid communication --.

Column 10, line 30, "fluid flow" should be -- said fulid communication --.

Signed and Sealed this

Third Day of August, 1999

*Attest:*

*Attesting Officer*

Q. TODD DICKINSON

*Acting Commissioner of Patents and Trademarks*